US009085169B2

(12) United States Patent
Yamanaka et al.

(10) Patent No.: US 9,085,169 B2
(45) Date of Patent: Jul. 21, 2015

(54) INKJET PRINTING APPARATUS AND METHOD OF CORRECTING STEP SHIFT THEREOF

(71) Applicant: DAINIPPON SCREEN MFG. CO., LTD., Kyoto (JP)

(72) Inventors: Kazuki Yamanaka, Kyoto (JP); Seiya Nomura, Kyoto (JP)

(73) Assignees: SCREEN Holdings Co., Ltd. (JP); Ricoh Company, Ltd. (JP)

( * ) Notice: Subject to any disclaimer, the term of this patent is extended or adjusted under 35 U.S.C. 154(b) by 0 days.

(21) Appl. No.: 14/283,890

(22) Filed: May 21, 2014

(65) Prior Publication Data

US 2015/0029256 A1 Jan. 29, 2015

(30) Foreign Application Priority Data

Jul. 29, 2013 (JP) ..... 2013-156589

(51) Int. Cl.
*B41J 29/393* (2006.01)
*B41J 2/21* (2006.01)

(52) U.S. Cl.
CPC ..... *B41J 2/2135* (2013.01); *B41J 2029/3935* (2013.01)

(58) Field of Classification Search
CPC ..... B41J 2/155
See application file for complete search history.

(56) References Cited

U.S. PATENT DOCUMENTS

| | | | | |
|---|---|---|---|---|
| 6,375,296 | B1 * | 4/2002 | McGarry et al. | 347/13 |
| 2007/0296752 | A1 * | 12/2007 | Maruo et al. | 347/19 |
| 2008/0240753 | A1 * | 10/2008 | Kobayashi | 399/45 |
| 2009/0085952 | A1 * | 4/2009 | Yamazaki | 347/19 |
| 2009/0225110 | A1 * | 9/2009 | Soler et al. | 347/9 |
| 2011/0310151 | A1 * | 12/2011 | Serizawa | 347/14 |

FOREIGN PATENT DOCUMENTS

| | | | |
|---|---|---|---|
| JP | 01009769 A | * | 1/1989 |
| JP | 4059119 | | 3/2008 |

* cited by examiner

*Primary Examiner* — Shelby Fidler
(74) *Attorney, Agent, or Firm* — Ostrolenk Faber LLP

(57) ABSTRACT

Provided is an inkjet printing apparatus configured to perform printing by discharging ink droplets onto a print medium. The apparatus includes a printing head having a plurality of inkjet heads and configured to perform printing by discharging the ink droplets from the plurality of inkjet heads onto the print medium; a chart printing device configured to print a step-shift correcting chart with the printing head; a reading device configured to read the step-shift correcting chart printed on the print medium; a print medium-processed portion detecting device configured to detect a processed portion of the print medium; an uninfluenced step-shift correcting-chart generating device configured to generate an uninfluenced step-shift correcting chart; and a shift-amount calculating device configured to calculate a shift amount for correcting the step shift in accordance with the uninfluenced step-shift correcting chart.

12 Claims, 9 Drawing Sheets

INKJET PRINTING APPARATUS AND METHOD OF CORRECTING STEP SHIFT THEREOF

1. TECHNICAL FIELD

The present invention relates to an inkjet printing apparatus configured to print characters or images on a print medium by performing discharge of ink droplets while moving the print medium and a printing head relatively, and a method of correcting the discharge. More particularly, the present invention is directed to a printing technique using a printing head constituted by a plurality of inkjet heads.

2. BACKGROUND ART

Examples of such a conventional apparatus include a printing apparatus configured to perform printing to a printing sheet by moving the printing sheet relative to a printing head only once. Such a printing apparatus is referred to as a one-pass system. When the printing head is provided for color printing, inkjet heads for the same color are arranged in a direction orthogonal to a transportation direction of the printing sheet (i.e., a width direction of the printing sheet), and inkjet heads for different colors are arranged in the transportation direction of the printing sheet. The inkjet heads form the printing head. The printing head having a plurality of inkjet heads for the same color arranged in the direction orthogonal to the transportation direction is referred to as a line head. When the inkjet heads for the same color have different timings of discharging ink droplets, an image to be linear in the direction orthogonal to the transportation direction is shifted in the transportation direction. Such step shift (also referred to as printing shift) occurs. The step shift should be corrected.

The step shift is corrected as under. For instance, the printing sheet subjected to printing is scanned with a scanner of a CIS (Contact Image Sensor) type to obtain a scanned image, and then step shift is determined from the scanned image. Thereafter, a discharge timing of the ink droplets for each of the inkjet heads is controlled in accordance with an amount of determined step shift.

Specifically, a step-shift correcting chart is printed on the printing sheet for determining the amount of step shift. Then, the printing sheet is transported such that the step-shift correcting chart is located within a scanning area of the scanner. The scanner reads the step-shift correcting chart to obtain an image, and analyzes the image to calculate the amount of step shift. See, for example, Japanese Patent No. 4059119.

However, the example of the conventional apparatus with such a construction has the following problems.

Some printing sheet has lateral perforations in a width direction thereof such that a printing area is easily separative. Here, the step-shift correcting chart may be located at the perforation. In such a case, the conventional apparatus cannot distinguish the lateral perforation from the step-shift correcting chart. Accordingly, the apparatus may fail analysis of the amount of step shift with the step-shift correcting chart, causing failure in calculation of the shift amount, or if possible, causing calculation of the shift amount with a low degree of accuracy. Such drawbacks may arise.

SUMMARY OF INVENTION

Additional features of the invention will be set forth in the description which follows, and in part will be apparent from the description, or may be learned by practice of the invention.

The present invention has been made regarding the state of the art noted above, and its one object is to provide an inkjet printing apparatus and a method of correcting step shift using the apparatus. The apparatus allows accurate calculation of an amount of step shift to even a print medium with a processed portion by eliminating an influence from the processed portion of the print medium.

In order to accomplish the above object, the present invention adopts the following construction.

One embodiment of the present invention is an inkjet printing apparatus configured to perform printing by discharging ink droplets onto a print medium. The apparatus includes a printing head having a plurality of inkjet heads and configured to perform printing by discharging the ink droplets from the plurality of inkjet heads onto the print medium; a chart printing device configured to print a step-shift correcting chart with the printing head, the step-shift correcting chart being used for correcting step shift as printing shift of the plurality of inkjet heads in a transportation direction; a reading device configured to read the step-shift correcting chart printed on the print medium; a print medium-processed portion detecting device configured to detect a processed portion of the print medium formed in a direction orthogonal to the transportation direction of the print medium; an uninfluenced step-shift correcting-chart generating device configured to eliminate an influence of the processed portion of the print medium detected by the print medium-processed portion detecting device from the step-shift correcting chart read by the reading device, thereby generating an uninfluenced step-shift correcting chart; and a shift-amount calculating device configured to calculate a shift amount for correcting the step shift in accordance with the uninfluenced step-shift correcting chart.

With the embodiment of the present invention, the chart printing device prints the step-shift correcting chart on the print medium through the printing head. The print medium-processed portion detecting device detects the processed portion of the print medium in the step-shift correcting chart read by the reading device. The uninfluenced step-shift correcting-chart generating device generates the uninfluenced step-shift correcting chart by eliminating the influence of the processed portion of the print medium detected by the print medium-processed portion detecting device. The shift-amount calculating device calculates the shift amount in accordance with the uninfluenced step-shift correcting chart. Consequently, accurate calculation of the shift amount of step shift can be performed even to the print medium with the processed portion.

Here, the "processed portion of the print medium" in the embodiment of the present invention is formed in the direction orthogonal to the transportation direction. Examples of the processed portion include a "lateral perforation" for facilitating separation of a printing area and a "punched hole" for integrating the print medium, and additionally include a "woven pattern", such as characters and patterns, formed on the print medium prior to printing. Moreover, the "step shift" in the embodiment of the present invention is applied to the following: not only between a plurality of inkjet heads arranged in the direction orthogonal to the transportation direction, e.g., between the inkjet heads for performing printing in the same color, but also between a plurality of inkjet heads arranged in the transportation direction, e.g., between the inkjet heads for performing printing in different colors for multi-color printing. Here, the inkjet heads move relatively to the print medium in the transportation direction.

Moreover, the chart printing device according to the embodiment of the present invention arranges a blank area at which the step-shift correcting chart is separate in the direction orthogonal to the transportation direction. The print medium-processed portion detecting device detects the processed portion of the print medium in accordance with the blank area. Such is preferable.

At the blank area, the step-shift correcting chart is separated in the direction orthogonal to the transportation direction. This helps the print medium-processed portion detecting device to detect the processed portion of the print medium even when the processed portion of the print medium formed in the direction orthogonal to the transportation direction overlaps the step-shift correcting chart.

Moreover, the chart printing device according to the embodiment of the present invention preferably prints a plurality of step-shift correcting charts in the transportation direction. Such is preferable.

This helps the reading device to read any of the step-shift correcting charts even when the step-shift correcting charts are not located in a reading area of the reading device accurately. Consequently, the step-shift correcting charts can be read regardless of transportation accuracy.

Moreover, the uninfluenced step-shift correcting-chart generating device in the embodiment of the present invention preferably generates the uninfluenced step-shift correcting chart from one of the plurality of step-shift correcting charts, the one not overlapping the processed portion of the print medium. Such is preferable.

The uninfluenced step-shift correcting chart is generated from one of the plurality of step-shift correcting charts that does not overlap the processed portion of the print medium, achieving accurate calculation of the shift amount.

Moreover, the chart printing device in the embodiment of the present invention preferably shifts the blank area in the direction orthogonal to the transportation direction toward downstream.

The blank area between the step-shift correcting charts is shifted in the direction orthogonal to the transportation direction toward downstream. Accordingly, a non-discharge nozzle of the printing head for forming the blank area is not fixed. Consequently, nozzle clogging of the printing head is avoidable when the step-shift correcting chart is printed.

Moreover, another embodiment of the present invention is a method of correcting step shift of an inkjet printing apparatus configured to perform printing by discharging ink droplets onto a print medium. The method includes a chart printing step of printing a step-shift correcting chart with a printing head having a plurality of inkjet heads on the print medium, the step-shift correcting chart being used for controlling the step shift as printing shift of the plurality of inkjet heads in a transportation direction; a reading step of reading the step-shift correcting chart printed on the print medium; a print medium-processed portion detecting step of detecting a processed portion of the print medium with the step-shift correcting chart printed thereon in a direction orthogonal to the transportation direction; an uninfluenced step-shift correcting-chart generating step of generating an uninfluenced step-shift correcting chart by eliminating an influence of the processed portion of the print medium from the step-shift correcting chart; and a shift amount calculating step of calculating a shift amount for correcting the step shift in accordance with the uninfluenced step-shift correcting chart.

With the embodiment of the present invention, the printing head prints the step-shift correcting chart on the print medium. The printed step-shift correcting chart is read. Then, the processed portion of the print medium in the read step-shift correcting chart is detected. Even if the processed portion of the print medium is contained in the step-shift correcting chart, the influence of the processed portion of the print medium is eliminated to generate the uninfluenced step-shift correcting chart. Thereafter, the shift amount is calculated in accordance with the uninfluenced step-shift correcting chart. Consequently, accurate calculation of an amount of step shift can be performed to the print medium with the processed portion.

It is to be understood that both the foregoing general description and the following detailed description are exemplary and explanatory and are intended to provide further explanation of the invention as claimed.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

Figure 1:
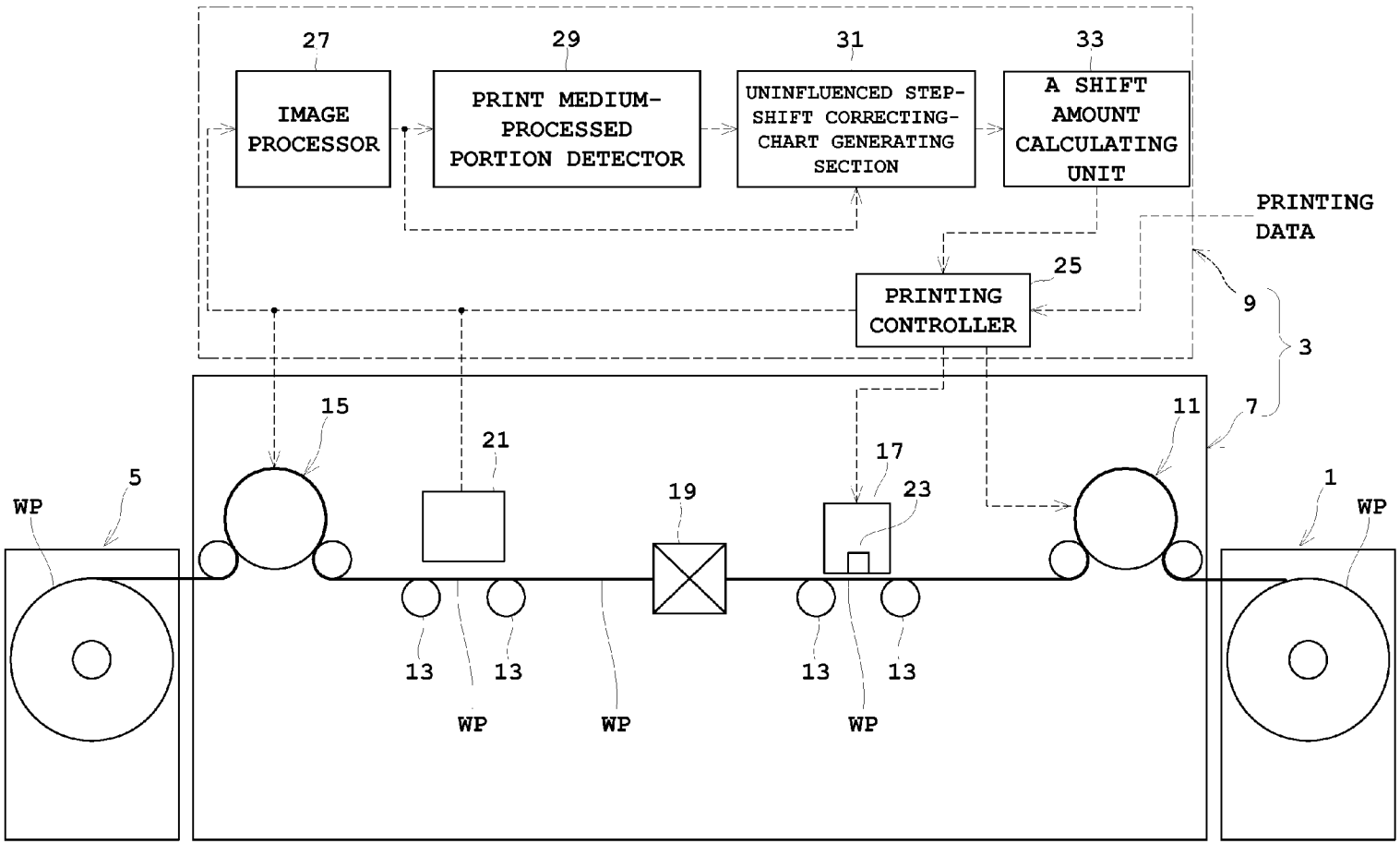
FIG. 1 is a block diagram illustrating an overall construction of an inkjet printing system according to one embodiment.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

The following describes one example of the present invention with reference to drawings.

FIG. 1 is a block diagram illustrating an overall construction of an inkjet printing system according to one embodiment.

The inkjet printing system according to the embodiment includes a paper feeder 1, an inkjet printing apparatus 3, and a take-up roller 5.

The paper feeder 1 holds web paper WP in a roll form to be rotatable about a horizontal axis, and unwinds the web paper WP to feed it to the inkjet printing apparatus 3. The inkjet printing apparatus 3 performs printing to the web paper WP. The take-up roller 5 winds up the web paper WP printed by the inkjet printing apparatus 3 about a horizontal axis. Regarding the side from which the web paper WP is fed as upstream and the side to which the web paper WP is taken up as downstream, the paper feeder 1 is disposed upstream of the inkjet printing apparatus 3 while the take-up roller 5 is disposed downstream of the inkjet printing apparatus 3.

The inkjet printing apparatus 3 includes a body 7 and a printing control unit 9. The body 7 includes a drive roller 11 in an upstream position thereof for taking in the web paper WP from the paper feeder 1. The web paper WP unwound from the paper feeder 1 by the drive roller 11 is transported downstream toward the take-up roller 5 along a plurality of transport rollers 13. A drive roller 15 is disposed between the most downstream transport roller 13 and the take-up roller 5. The drive roller 15 feeds the web paper WP travelling on the transport rollers 13 toward the take-up roller 5.

Between the drive rollers 11 and 15, the body 7 of the inkjet printing apparatus 3 has a printing head 17, a drying unit 19, and an inspecting unit 21 arranged in this order from upstream to downstream.

The printing head 17 includes inkjet heads 23 configured to discharge ink droplets. The inkjet heads 23 are arranged over a width of the web paper WP (in a direction perpendicular to the plane of a width direction of FIG. 1). A plurality of printing heads 17 is typically arranged in a transportation direction of the web paper WP. For instance, four printing heads 17 for black (K), cyan (C), magenta (M), and yellow (Y), respectively, are provided separately. However, in order to facilitate understanding of the invention, the following description will be given on the assumption that only one printing head 17 is provided.

The drying unit 19 dries a printing face of the web paper WP onto which the ink droplets are discharged and thereby an image is printed. The drying unit 19 includes a heat drum not shown. The heat drum contacts a non-printing face of the web paper WP, thereby drying the ink droplets applied to the printing face of the web paper WP.

The inspecting unit 21 images the printing face for inspecting the printing face of the web paper WP for any stains or omissions, and images a step-shift correcting chart, to be mentioned later. The inspecting unit 21 includes a camera or an optical system. The inspecting unit 21 images the web paper WP fed immediately therebelow, and outputs the result as an inspecting image.

The printing control unit 9 controls printing by the body 7 of the inkjet printing apparatus 3. Specifically, the printing control unit 9 receives printing data, corresponding to the image to be printed, from an external computer. The printing control unit 9 performs operation to the body 7 in accordance with the printing data. The printing control unit 9 receives the inspection result from the inspecting unit 21, and informs an operator of the inspection result, or suspends operation of the body 7 of the inkjet printing apparatus 3. In addition, the shift amount calculating unit 33 calculates an amount of step shift in accordance with the step-shift correcting chart, to be mentioned later, as the printing shift in the transportation direction. Then, a timing of discharging the ink droplets from a plurality of inkjet heads 23 is controlled in accordance with the shift amount.

Here, the inspecting unit 21 corresponds to the "reading device" in the present invention.

Figure 2:
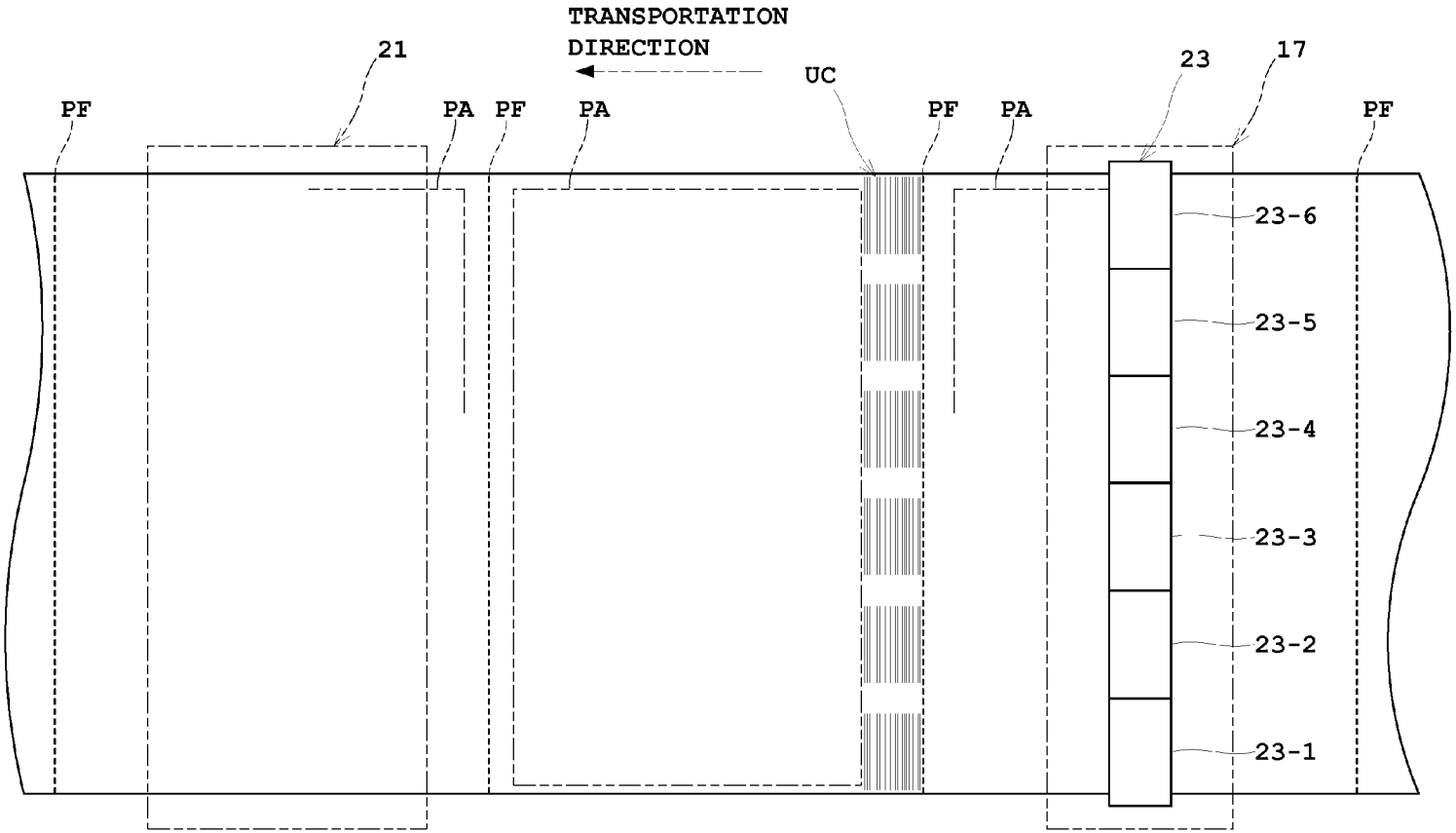
FIG. 2 is a schematic view of a positional relationship between a printing area and a step-shift correcting chart.
Figure 3:
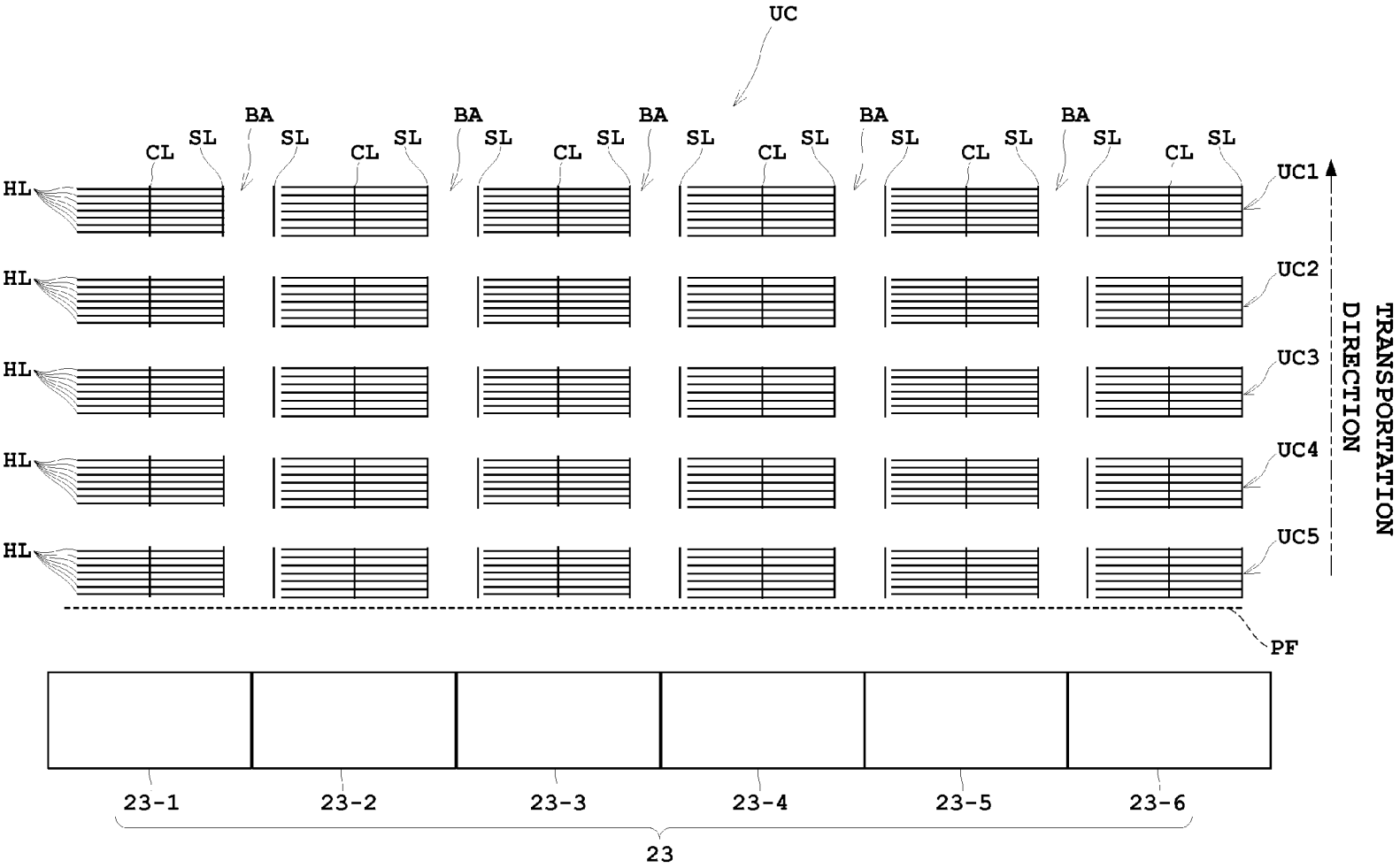
FIG. 3 is a schematic view of a positional relationship between the step-shift correcting chart and a printing head.
Figure 4:
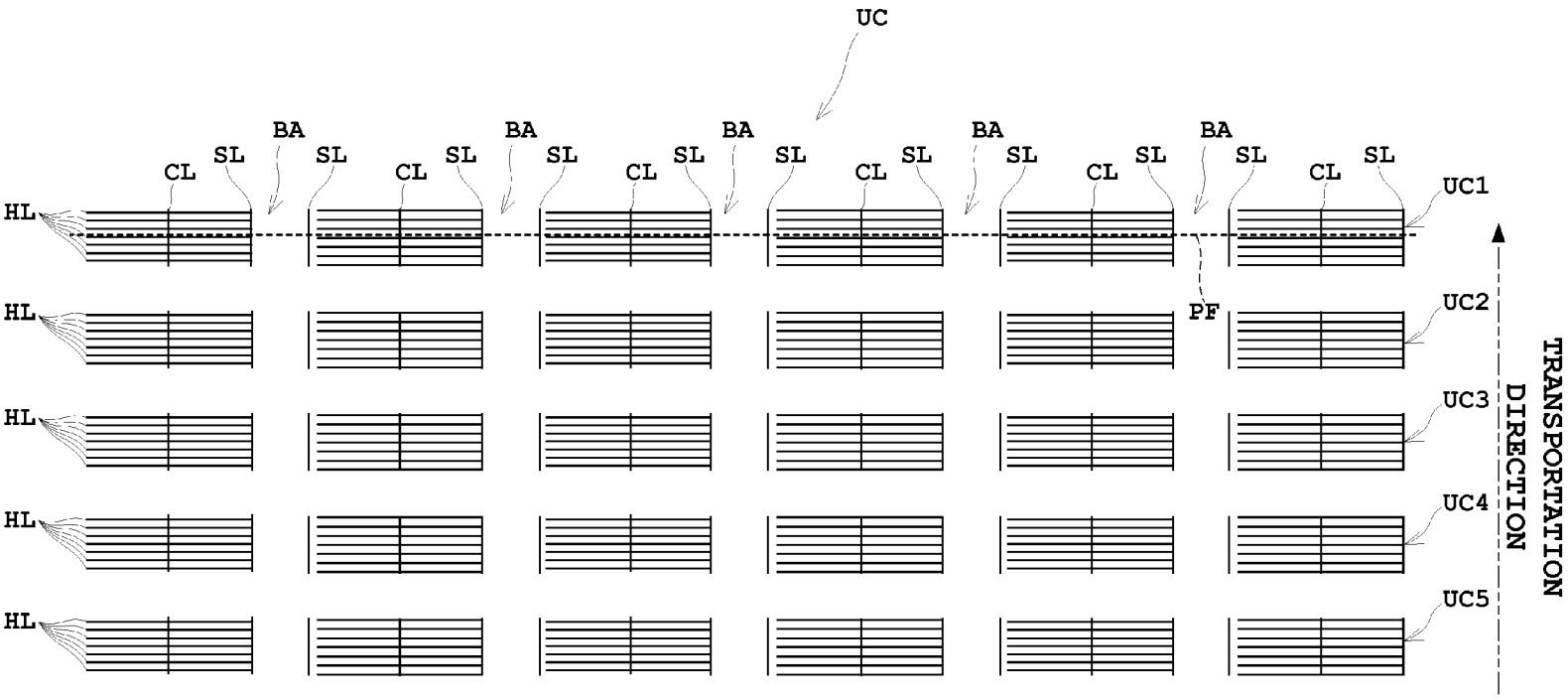
FIG. 4 is a schematic view illustrating a condition where a lateral perforation overlaps the step-shift correcting chart.

Now reference is made to FIGS. 2 to 4. FIG. 2 is a schematic view illustrating a positional relationship between a printing area and a step-shift correcting chart. FIG. 3 is a schematic view illustrating a positional relationship between the step-shift correcting chart and the printing head. FIG. 4 is a schematic view illustrating a condition where the step-shift correcting chart overlaps a lateral perforation.

As illustrated in FIG. 2, the web paper WP of the embodiment has lateral perforations PF. The lateral perforations PF are formed by given intervals in a width direction orthogonal to the transportation direction. A printing area PA is provided between the lateral perforations PF. In FIG. 2, as one example, a step-shift correcting chart UC is printed between the lateral perforations PF downstream of the printing areas PA. In actual, however, when the step-shift correcting chart UC is printed, the printing controller 25 of the printing control unit 9 performs no control. That is, only the step-shift correcting chart UC is printed at an appropriate position without detecting a position of the lateral perforation PF. Accordingly, the step-shift correcting chart UC may overlap the lateral perforation PF. As illustrated in FIG. 3, the step-shift correcting chart UC includes five rows, i.e., five step-shift correcting charts UC1 to UC5 printed in the transportation direction of the web paper WP. Hereinunder, a number is added to the numeral UC when the step-shift correcting charts UC1 to UC5 should be identified. Otherwise, merely the numeral UC is indicated. In the embodiment, the printing head 17 includes six inkjet head 23*c* (numerals 23-1 to 23-6). Similar to the above, a number is added to the numeral 23 only when the inkjet heads 23 should be identified.

As illustrated in FIG. 3, the step-shift correcting chart UC in the embodiment includes a plurality of (e.g., seven) lateral lines HL, the lateral lines being printed in a direction orthogonal to the transportation direction, blank areas BA printed in the direction orthogonal to the transportation direction so as to separate the lateral lines HL, center lines CL printed in the transportation direction along the substantial center of the inkjet heads 23-1 to 23-6 in a width direction thereof, respectively, so as to cross the lateral lines HL, and separation lines SL printed on both ends of each of the blank areas BA in the transportation direction. A plurality of lateral lines HL printed by given intervals in the transportation direction is different between the inkjet heads 23-1, 3, 5 with odd numbers, and the inkjet heads 23-2, 4, 6 with even numbers. The lateral lines HL for the even numbers have intervals slightly larger than the lateral lines HL for the odd numbers.

As mentioned above, the step-shift correcting chart UC is printed downstream of the printing area PA and upstream of the lateral perforation PF. Here, as illustrated in FIG. 4, it is assumed that the lateral perforation PF overlaps one of the step-shift correcting charts UC, i.e., the step-shift correcting chart UC1.

The amount of step shift is to be mentioned later in detail. The amount is calculated from deviations in intersections of the center lines CL and the lateral lines HL of the step-shift correcting charts UC adjacent to each other. Accordingly, when the lateral perforation PF overlaps the step-shift correcting chart UC, the intersection of the center line CL and the lateral line HL is not obtainable accurately, causing inaccurate calculation of the amount of step shift. Consequently, the printing control unit 9 eliminates an influence of the lateral perforation PF through a process to be mentioned later.

The printing control unit 9 includes a printing controller 25, an image processor 27, a print medium-processed portion detector 29, an uninfluenced step-shift correcting-chart generating section 31, and a shift amount calculating unit 33.

The printing controller 25 performs control about printing mentioned above, and additionally performs printing by controlling a timing of discharging the ink droplets in accordance with the calculate shift amount so as not to generate the step shift.

The image processor 27 performs image processing to the step-shift correcting chart UC imaged and read by the inspecting unit 21. Specifically, binarization is performed by averaging pixel values of five rows of step-shift correcting charts UC in the width direction of the web paper WP. Thereafter, printed areas of the five rows of step-shift correcting charts US, i.e., UC1 to UC5 are each determined. Moreover, binarization is performed by averaging each of the step-shift correcting charts UC1 to UC5 in the transportation direction. Thereafter, the center lines CL and separation lines SL of the step-shift correcting charts UC1 to UC5 for the inkjet heads 23-1 to 23-6 are each detected. The center lines CL and the separation lines SL are each detected to obtain the number thereof. The blank areas BA in the step-shift correcting charts UC1 to UC5 are identified in accordance with the number.

Thereafter, the print medium-processed portion detector 29 averages the blank areas BA in the direction orthogonal to the transportation direction. In addition, the print medium-processed portion detector 29 determines pixel value distribution in the transportation direction to calculate kurtosis, and determines that a lateral perforation PF exists when the kurtosis is more than or equal to a threshold. Then, the uninfluenced step-shift correcting-chart generating section 31 precludes a step-shift correcting chart UC containing the lateral perforation PF from a processing object to generate an uninfluenced step-shift correcting chart NUC from which an influence of the lateral perforation PF is removed. Specifically, an uninfluenced step-shift correcting chart NUC with no lateral perforation PF is selected from five step-shift correcting charts UC1 to UC5. In the case with a plurality of step-shift correcting charts UC, a step-shift correcting chart UC adjacent to that with the lateral perforation PF is adopted as an uninfluenced step-shift correcting chart NUC.

As mentioned above, upon detecting the lateral perforation PF, averaging is performed in the direction orthogonal to the transportation direction, and determination is performed whether or not the kurtosis is more than or equal to the threshold. Consequently, an error of detecting stains as the lateral perforation PF is avoidable, the stains being generated due to fall of the ink droplets onto the web paper WP or due to friction of the ink droplets.

The shift amount calculating unit 33 calculates an amount of step shift of the adjacent inkjet heads 23 in accordance with the intersections of the center lines CL and the lateral lines HL of the uninfluenced step-shift correcting chart NUC. The calculated shift amount is sent to the printing controller 25. The printing controller 25 controls a timing of discharging the ink droplets in accordance with the received shift amount.

Here, the printing controller 25 corresponds to the "chart printing device" in the present invention. The print medium-processed portion detector 29 corresponds to the "print medium-processed portion detecting device" in the present invention. The uninfluenced step-shift correcting-chart generating section 31 corresponds to the "uninfluenced step-shift correcting-chart generating device" in the present invention. The shift amount calculating unit 33 corresponds to the "shift-amount calculating device" in the present invention.

Figure 5:
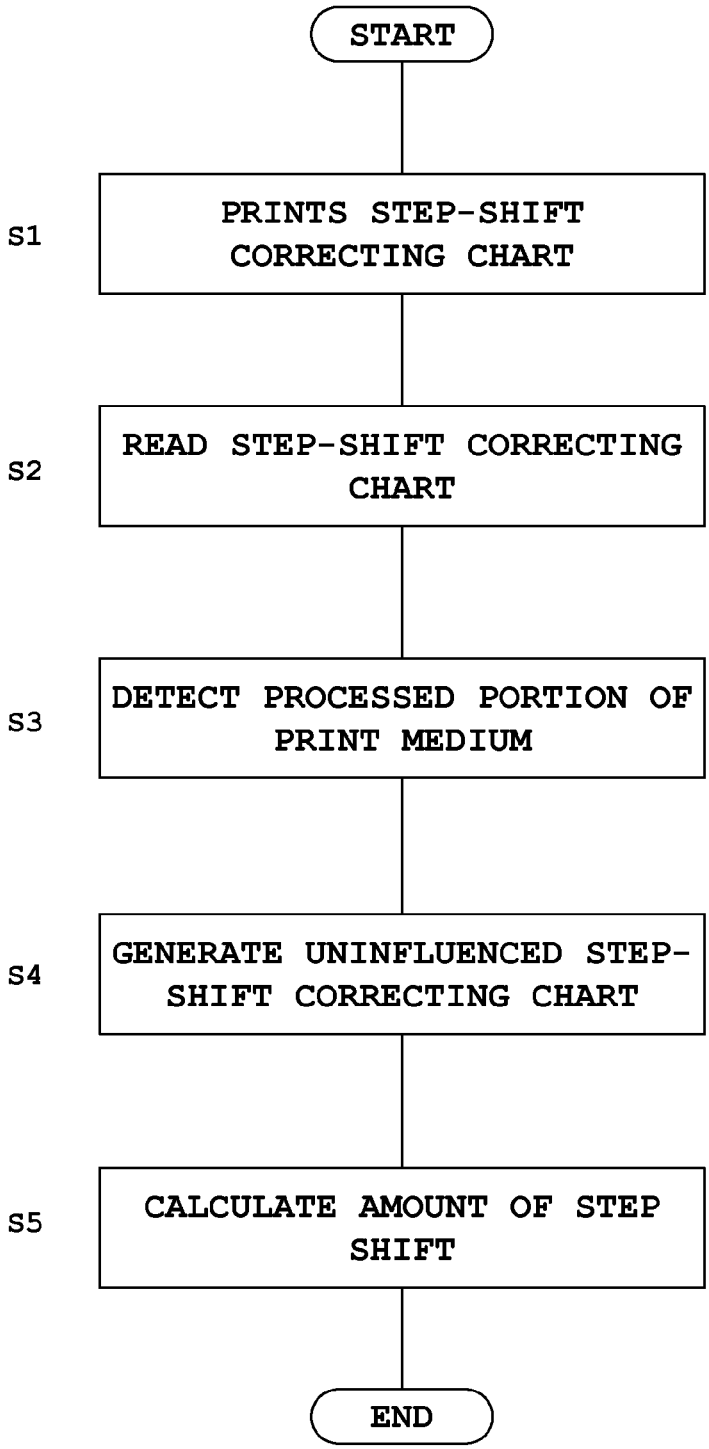
FIG. 5 is a flow chart illustrating a process of determining a shift amount for correcting step shift.
Figure 6:
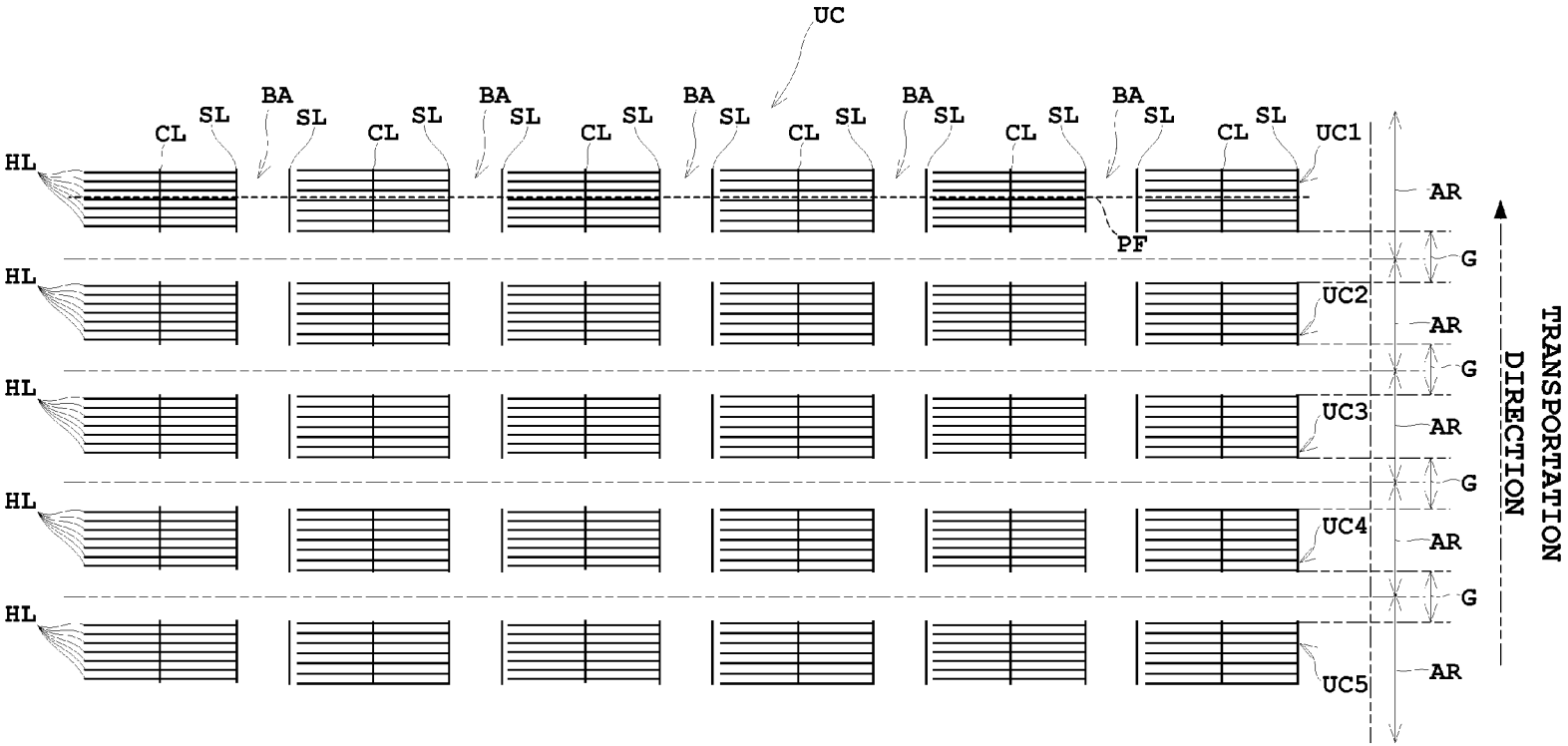
FIG. 6 is an explanatory schematic view for a process of identifying an area width of each of a plurality of rows of the step-shift correcting charts.
Figure 7:
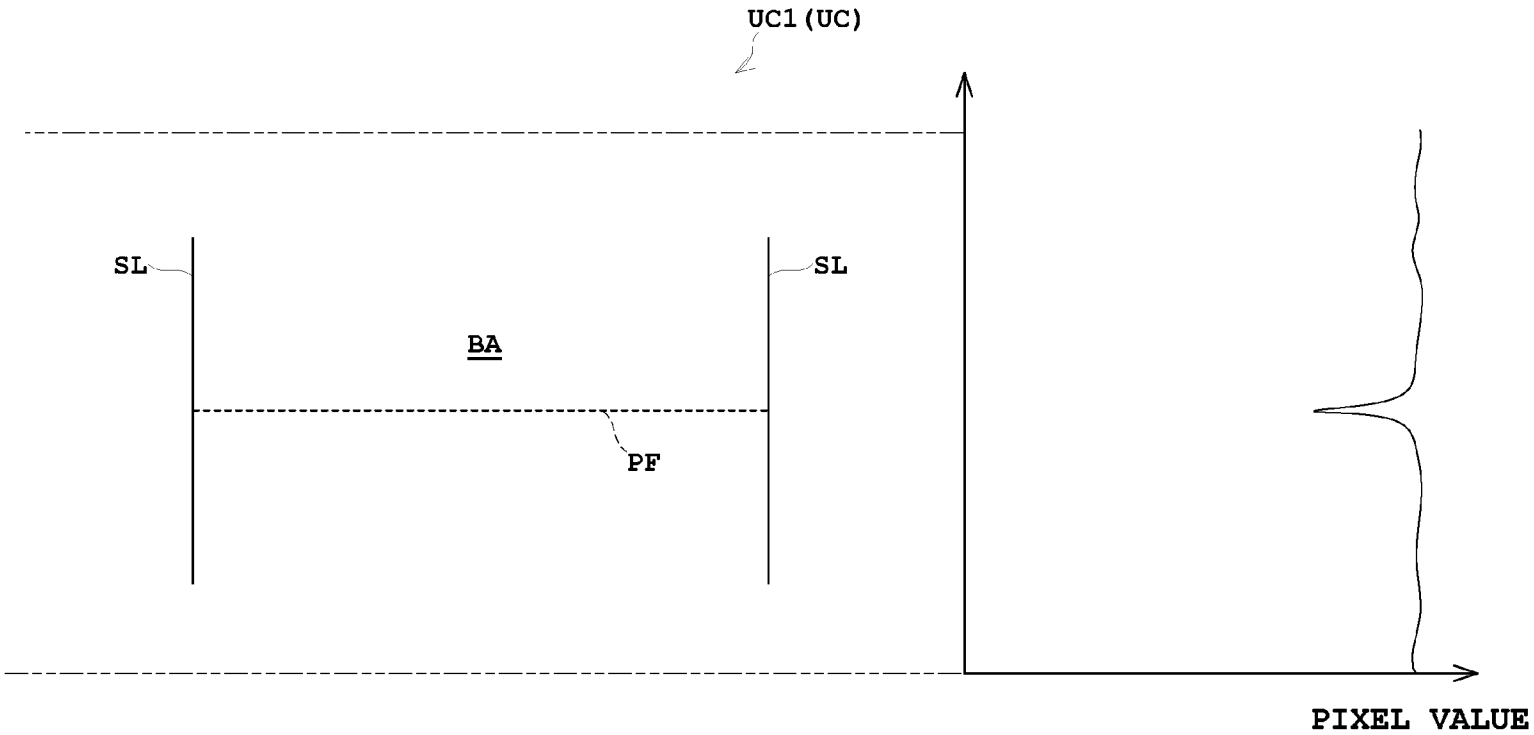
FIG. 7 is an explanatory schematic view of determining presence or absence of the lateral perforation.
Figure 8:
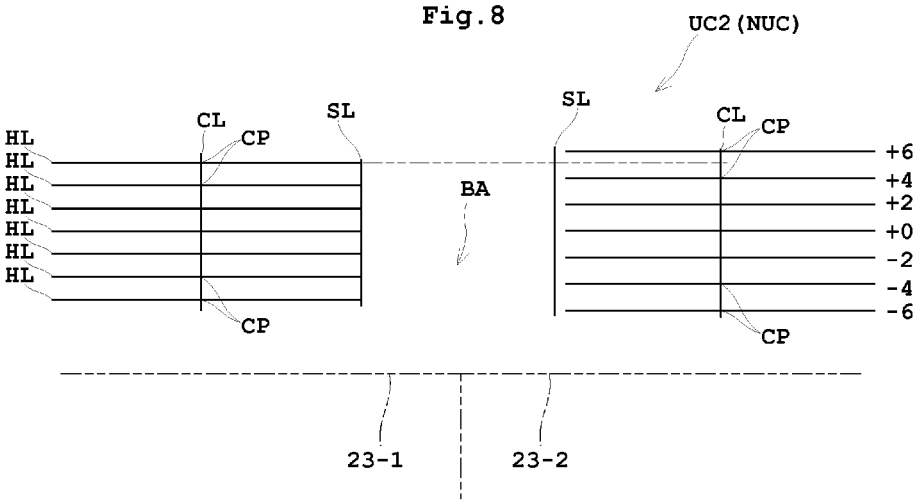
FIG. 8 illustrates a step-shift correcting chart with first and second inkjet heads.
Figure 9:
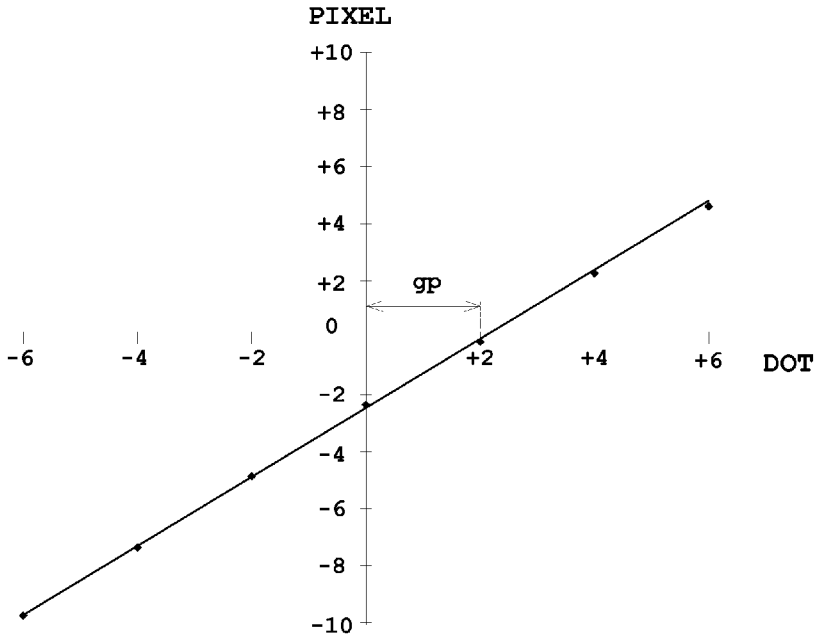
FIG. 9 is a graph for determining the shift amount.

Reference is next made to FIGS. 5 to 9. FIG. 5 is a flow chart illustrating a process of determining the shift amount for correcting the step shift. FIG. 6 is an explanatory schematic view illustrating a process of identifying an area width of the step-shift correcting chart from the chart printing area containing a plurality of rows of step-shift correcting charts. FIG. 7 is an explanatory schematic view illustrating a process of determining presence or absence of the lateral perforation. FIG. 8 illustrates a step-shift correcting chart with first and second inkjet heads. FIG. 9 is a graph for determining the shift amount.

Step S1

As illustrated in FIG. 2, the printing controller 25 prints a step-shift correcting chart UC downstream of the printing area PA in the web paper WP. At this time, it is assumed that the lateral perforation PF overlaps the correcting chart UC1 as illustrated in FIG. 4.

Step S2

The printing controller 25 transports the web paper WP such that the step-shift correcting chart UC is located in a reading area of the inspecting unit 21, whereby the inspecting unit 21 reads the step-shift correcting chart UC. Since a plurality of step-shift correcting charts UC is printed, any of the step-shift correcting charts UC is readable although a suspending position of the web paper WP after transportation is slightly shifted from the reading area of the inspecting unit 21.

The image processor 27 performs binarization to each of the step-shift correcting charts UC1 to UC5 by averaging the pixel values in the width direction of the web paper WP. Thereafter, as illustrated in FIG. 6, an area width AR in the transportation direction is determined in the read image. In the area width AR, each of the step-shift correcting charts UC1 to UC5 is printed. Specifically, gaps G between the step-shift correcting charts UC1 to UC5 in the transportation direction are detected. Then the area width AR is each set in accordance with an intermediate position of the gaps G, respectively, in the transportation direction. Here, there is no blank area over the top step-shift correcting chart UC1 and below the bottom step-shift correcting chart UC5. In this case, an intermediate position may be set between the end of the read image and the top and the bottom step-shift correcting chart UC1 and UC5, respectively. Moreover, binarization is performed to each of the step-shift correcting charts UC1 to UC5 by averaging the step-shift correcting charts UC1 to UC5 within the area widths AR in the transportation direction. Consequently, the center lines CL and the lateral lines HL of the step-shift correcting charts UC1 to UC5 are detected for the inkjet head 23-1 to 23-6, respectively. The center lines CL and the lateral lines HL are each detected to obtain the number thereof. Accordingly, the blank areas BA in the step-shift correcting charts UC1 to UC5 are each identified.

Step S3

The print medium-processed portion detector 29 performs averaging to the blank areas BA in the direction orthogonal to the transportation direction as illustrated in FIG. 7, thereby determining pixel value distribution in the transportation direction. The kurtosis is calculated from the pixel value distribution. When the kurtosis is more than or equal to the threshold, it is determined that a lateral perforation PF exists. In FIG. 7 with a lateral perforation PF, a pixel value at the lateral perforation PF is extremely higher than that at the other portion. Accordingly, the kurtosis becomes high. Consequently, it is determinable that the step-shift correcting chart UC1 contains the lateral perforation PF.

Step S4

The uninfluenced step-shift correcting-chart generating section 31 generates an uninfluenced step-shift correcting chart NUC from the step-shift correcting charts UC2 to UC5 other than the step-shift correcting chart UC1 containing the lateral perforation PF. Here, among the five step-shift correcting charts UC1 to UC5, the step-shift correcting chart UC2 is selected to be an uninfluenced step-shift correcting chart NUC. The step-shift correcting chart UC2 contains no lateral perforation PF and is adjacent to the step-shift correcting chart UC1 containing the lateral perforation PF.

Step S5

As illustrated in FIGS. 8 and 9, the shift amount calculating unit 33 calculates an amount of step shift between the adjacent inkjet heads 23 in accordance with the intersections of the center line CL and the lateral lines HL of the uninfluenced step-shift correcting chart NUC. Here, only a shift amount of a first inkjet head 23-1 and a second inkjet head 23-2 is described. A shift amount of the other inkjet heads 23 is obtainable in the same manner. Firstly, differences in the transportation direction is determined between intersections CP of the lateral lines HL and the center line CL for the first inkjet head 23-1 and those of the lateral lines HL and the center line CL for the second inkjet head 23-2. Binarization is performed by averaging the uninfluenced step-shift correcting charts NUC, corresponding to the first inkjet head 23-1 and the second inkjet head 23-2, in the direction orthogonal to the transportation direction. Consequently, positions of the center line CL on the lateral lines HL are determined. At this time, sub-pixel estimation is used for determining the positions at higher accuracy than a resolution of the inspecting unit 21. An average value of the position of the lateral line HL determined with sub-pixel units is adopted as a position of the intersection CP. In such a manner, intersections CP on seven lateral lines HL are determined to obtain differences between the intersections CP of the lines HL for the first and second inkjet heads 23-1, 23-2. FIG. 9 is a graph in which a horizontal axis represents the lateral line HL and a longitudinal axis represents the differences, and the differences of all the intersections CP are plotted to obtain an approximating line. In the graph, an intersection of the approximating line and the horizontal axis is a shift amount.

As mentioned above, the shift amount is calculated in accordance with the uninfluenced step-shift correcting chart NUC. Accordingly, the amount of step shift is accurately obtainable even for the web paper WP with the lateral perforation PF. The shift amount is calculated for every inkjet head 23-1 to 23-6, and the shift amount is sent to the printing controller 25. Then the printing controller 25 performs printing while controlling a timing of discharging the ink droplets from each of the inkjet heads 23-1 to 23-6 in accordance with the shift amount. As a result, the printing head 17 constituted by a plurality of inkjet heads 23-1 to 23-6 can eliminate the step shift as the printing shift in the transportation direction.

With the embodiment of the present invention, the printing control unit 9 controls the printing head 17 so as to print the step-shift correcting chart UC on the web paper WP, and then controls the inspecting unit 21 to read the printed step-shift correcting chart UC. Thereafter, the lateral perforation PF in the read step-shift correcting chart UC is detected. Accordingly, even if a lateral perforation PF exists, the uninfluenced step-shift correcting chart NUC is generated by eliminating the influence of the lateral perforation PF. Then, the shift amount is calculated in accordance with the uninfluenced step-shift correcting chart NUC. This achieves accurate calculation of the shift amount of step shift even for the web paper WP with the lateral perforation PF.

This invention is not limited to the foregoing examples, but may be modified as follows.

(1) In the embodiment mentioned above, the web paper WP has been described as one example of the print medium. Alternatively, the present invention is applicable to other print medium, such as a film.

Figure 10:
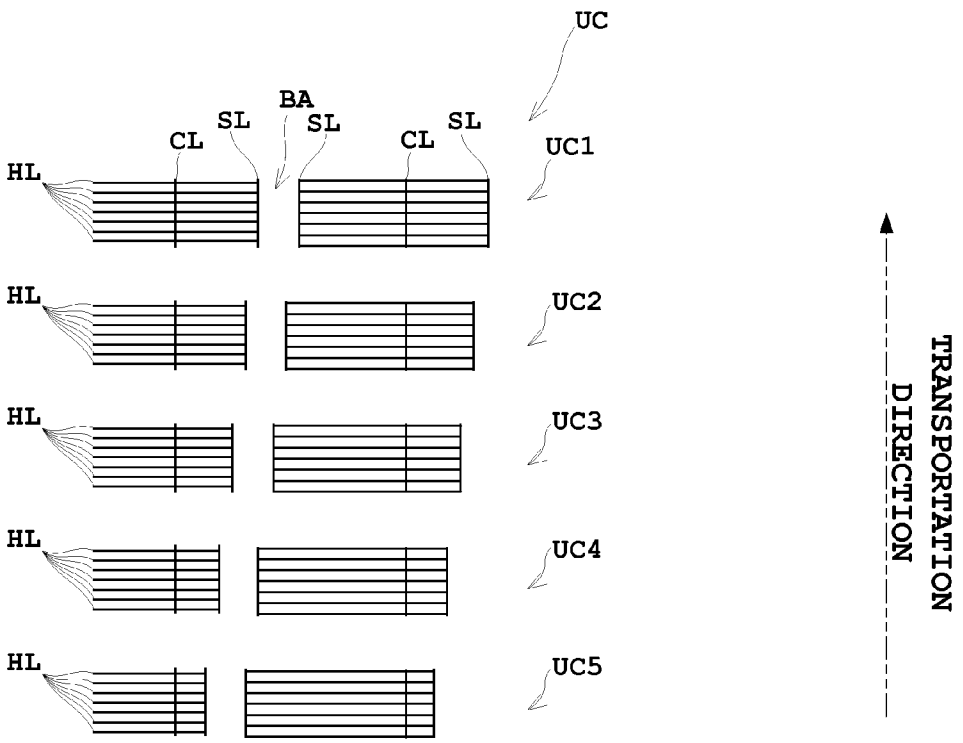
FIG. 10 is a schematic view of a step-shift correcting chart according to one modification.

(2) In the embodiment mentioned above, the blank areas BA are arranged in a straight line in the transportation direction. Alternatively, as illustrated in FIG. 10, the blank areas BA may be shifted in the direction orthogonal to the transportation direction toward downstream. This can eliminate fixation of the non-discharging nozzle in the printing head 17 for generating the blank areas BA. Consequently, nozzle clogging of the printing head 17 is avoidable upon printing the step-shift correcting chart UC.

(3) In the embodiment mentioned above, the lateral lines HL of the step-shift correcting charts UC for the adjacent inkjet heads 23 have different intervals. Alternatively, the lateral lines HL may all have the same interval.

(4) In the embodiment mentioned above, five step-shift correcting charts UC1 to UC5 are printed. The present invention, however, is not limited to this. Alternatively, two or more or four or less step-shift correcting charts UC, or six or more step-shift correcting charts UC may be printed.

(5) In the embodiment mentioned above, the step shift for the six inkjet heads 23-1 to 23-6 has been described as one example, the inkjet heads performing printing in the same color and being arranged in the direction orthogonal to the transportation direction in which they move relatively to the web paper WP. Alternatively, the present invention is applicable to a plurality of inkjet heads 23 arranged in the transportation direction in which they move relatively to the web paper WP, e.g., the inkjet head 23 performing printing in difference colors, in the case of multi-color printing.

(6) In the embodiment mentioned above, the lateral perforation PF is determined from the blank areas BA using the kurtosis. Alternatively, the following may be adopted. That is, the blank areas BA are scanned at an area narrower than the interval of the lateral perforation PF to be subject to averaging in the direction orthogonal to the transportation direction. Then a lowest intensity value of the pixel value distribution is compared for the step-shift correcting charts UC1 to 5. The step-shift correcting chart UC with the lowest intensity value is considered as a chart possibly containing the lateral perforation PF, and then eliminated. Thereafter, an uninfluenced step-shift correcting chart NUC is generated from the remaining step-shift correcting charts UC.

As mentioned above, the area narrower than the interval of the lateral perforation PF is scanned, whereby the image is obtainable having two or more lateral perforations PF not to appearing therein. Among the step-shift correcting charts UC, the step-shift correcting chart UC containing the lateral perforation PF has the lowest intensity of the pixel value distribution in the blank area BA. Consequently, eliminating the step-shift correcting chart UC containing the lowest intensity of the pixel value distribution achieves generation of the uninfluenced step-shift correcting chart NUC from the remaining step-shift correcting charts UC. When the scanned image contains no lateral perforation PF, one step-shift correcting chart UC with no lateral perforation PF is to be eliminated. This causes no harm since another step-shift correcting chart UC is adopted as the uninfluenced step-shift correcting chart NUC.

The present invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus configured to perform printing by discharging ink droplets onto a print medium, the apparatus comprising:

a printing head having a plurality of inkjet heads and configured to perform printing by discharging the ink droplets from the plurality of inkjet heads onto the print medium;

a chart printing device configured to print a step-shift correcting chart with the printing head, the step-shift correcting chart having a plurality of lines orthogonal to the transportation direction and a blank area separating the plurality of lines and being used for correcting step shift as printing shift of the plurality of inkjet heads in a transportation direction;

a reading device configured to read the step-shift correcting chart printed on the print medium;

a print medium-processed portion detecting device configured to detect a processed portion of the print medium formed in a direction orthogonal to the transportation direction of the print medium in accordance with the blank area;

an uninfluenced step-shift correcting-chart generating device configured to eliminate an influence of the processed portion of the print medium detected by the print medium-processed portion detecting device from the step-shift correcting chart read by the reading device, thereby generating an uninfluenced step-shift correcting chart; and a shift-amount calculating device configured to calculate a shift amount for correcting the step shift in accordance with the uninfluenced step-shift correcting chart.

2. The inkjet printing apparatus according to claim 1, wherein the chart printing device prints a plurality of step-shift correcting charts in the transportation direction.

3. The inkjet printing apparatus according to claim 2, wherein the uninfluenced step-shift correcting-chart generating device generates the uninfluenced step-shift correcting chart from one of the plurality of step-shift correcting charts, the one not overlapping the processed portion of the print medium.

4. The inkjet printing apparatus according to claim 3, wherein the chart printing device shifts the blank area in the direction orthogonal to the transportation direction toward downstream by movement of a non-discharge nozzle of the printing head.

5. The inkjet printing apparatus according to claim 2, wherein the chart printing device shifts the blank area in the direction orthogonal to the transportation direction toward downstream by movement of a non-discharge nozzle of the printing head.

6. The inkjet printing apparatus according to claim 1, wherein the chart printing device shifts the blank area in the direction orthogonal to the transportation direction toward downstream by movement of a non-discharge nozzle of the printing head.

7. A method of correcting step shift of an inkjet printing apparatus configured to perform printing by discharging ink droplets onto a print medium, the method comprising:

a chart printing step of printing a step-shift correcting chart with a printing head having a plurality of inkjet heads on the print medium, the step-shift correcting chart having a plurality of lines orthogonal to the transportation direction and a blank area separating the plurality of lines and being used for controlling the step shift as printing shift of the plurality of inkjet heads in a transportation direction;

a reading step of reading the step-shift correcting chart printed on the print medium;

a print medium-processed portion detecting step of detecting a processed portion of the print medium with the step-shift correcting chart printed thereon in a direction orthogonal to the transportation direction in accordance with the blank area;

an uninfluenced step-shift correcting-chart generating step of generating an uninfluenced step-shift correcting chart by eliminating an influence of the processed portion of the print medium from the step-shift correcting chart; and a shift amount calculating step of calculating a shift amount for correcting the step shift in accordance with the uninfluenced step-shift correcting chart.

8. The method of correcting step shift of the inkjet printing apparatus according to claim 7, wherein the chart printing device prints a plurality of step-shift correcting charts in the transportation direction.

9. The method of correcting step shift of the inkjet printing apparatus according to claim 8, wherein the uninfluenced step-shift correcting-chart generating device generates the uninfluenced step-shift correcting chart from one of the plurality of step-shift correcting charts, the one not overlapping the processed portion of the print medium.

10. The method of correcting step shift of the inkjet printing apparatus according to claim 9, wherein the chart printing device shifts the blank area in the direction orthogonal to the transportation direction toward downstream by movement of a non-discharge nozzle of the printing head.

11. The method of correcting step shift of the inkjet printing apparatus according to claim 8, wherein the chart printing device shifts the blank area in the direction orthogonal to the transportation direction toward downstream by movement of a non-discharge nozzle of the printing head.

12. The method of correcting step shift of the inkjet printing apparatus according to claim 7, wherein the chart printing device shifts the blank area in the direction orthogonal to the transportation direction toward downstream by movement of a non-discharge nozzle of the printing head.

* * * * *